US008826609B1

(12) United States Patent
Chang

(10) Patent No.: US 8,826,609 B1
(45) Date of Patent: Sep. 9, 2014

(54) DECK PLANK

(71) Applicant: Hudson Hardware & Plastics Co., Limited, Guangdong (CN)

(72) Inventor: Tsu-Kang Chang, Guangdong (CN)

(73) Assignee: Hudson Hardware & Plastics Co., Limited, Dongguan (CN)

( * ) Notice: Subject to any disclaimer, the term of this patent is extended or adjusted under 35 U.S.C. 154(b) by 0 days.

(21) Appl. No.: 13/830,099

(22) Filed: Mar. 14, 2013

(51) Int. Cl.
*E04F 11/16* (2006.01)
*E04F 15/02* (2006.01)
*E04B 1/64* (2006.01)

(52) U.S. Cl.
CPC ..... *E04B 1/64* (2013.01); *E04F 15/02161* (2013.01); *E04F 15/02033* (2013.01); *E04F 15/02038* (2013.01)
USPC ..... 52/177; 52/579; 52/580; 52/581

(58) Field of Classification Search
CPC ... E04F 15/02; E04F 15/10; E04F 2201/0115; E04F 2201/05; E04F 2201/025; E04F 2203/04; E04F 2201/095; E04F 15/02183; E04F 19/061; E04F 13/0864; E04F 2201/022; E04B 5/00; E04B 1/003; B32B 3/30
USPC ..... 52/177, 578, 579, 580, 581
See application file for complete search history.

(56) References Cited

U.S. PATENT DOCUMENTS

| | | | | |
|---|---|---|---|---|
| 5,048,448 | A * | 9/1991 | Yoder | 114/263 |
| 5,205,092 | A * | 4/1993 | Taylor | 52/177 |
| 5,613,339 | A * | 3/1997 | Pollock | 52/836 |
| 5,758,456 | A * | 6/1998 | Case | 52/177 |
| 6,044,598 | A * | 4/2000 | Elsasser et al. | 52/181 |
| 6,427,395 | B1 * | 8/2002 | Elsasser et al. | 52/181 |
| 6,637,163 | B2 * | 10/2003 | Thibault et al. | 52/177 |
| 2009/0266022 | A1 * | 10/2009 | Lin | 52/506.1 |
| 2010/0263317 | A1 * | 10/2010 | Genova | 52/588.1 |

* cited by examiner

*Primary Examiner* — William Gilbert
*Assistant Examiner* — Gisele Ford
(74) *Attorney, Agent, or Firm* — Birch, Stewart, Kolasch & Birch, LLP

(57) ABSTRACT

A deck plank has at least one base, a top board and two reinforcing ribs. The at least one base includes a carrier board and a plurality of support columns. The support columns extend from a bottom surface of the carrier board. The top board is mounted on a top of the at least one base and has two receiving cavities therein for receiving the reinforcing ribs. To construct a deck, a plurality of deck planks are placed side by side on the ground. The top boards are spaced from the ground by the support columns of the base such that the moisture from the ground does not penetrate the top board to cause the top board to become damp and rot. In addition, the top board is structurally reinforced by the reinforcing ribs to prevent deformation.

3 Claims, 4 Drawing Sheets

DECK PLANK

BACKGROUND OF THE INVENTION

1. Field of the Invention

The present invention relates generally to decks, and more particularly to a deck plank that resists moisture penetration and deformation.

2. Description of the Related Art

A deck can be constructed both indoors and outdoors, and the deck consists of a number of deck planks placed side by side on the ground. The deck planks may be made of wood.

However, the moisture from the ground may penetrate the deck planks and cause the deck planks to become damp and then rot. In addition, the deck planks are not structurally reinforced and may be easily deformed.

To overcome the shortcomings, the present utility model provides a deck plank to mitigate or obviate the aforementioned problems.

SUMMARY OF THE INVENTION

The present invention provides a deck plank that resists moisture penetration and deformation.

A deck plank in accordance with the present invention comprises at least one base, a top board and two reinforcing ribs. The at least one base includes a carrier board and a plurality of support columns. The support columns extend from a bottom surface of the carrier board. The top board is mounted on a top of the at least one base and has two receiving cavities therein for receiving the reinforcing ribs. To construct a deck, a plurality of deck planks are placed side by side on the ground. The top boards are spaced from the ground by the support columns of the base such that the moisture from the ground does not penetrate the top board to cause the top board to become damp and rot. In addition, the top board is structurally reinforced by the reinforcing ribs to prevent deformation.

Other objectives, advantages and novel features of the utility model will become more apparent from the following detailed description when taken in conjunction with the accompanying drawings.

DETAILED DESCRIPTION OF THE PREFERRED EMBODIMENTS

Figure 1:
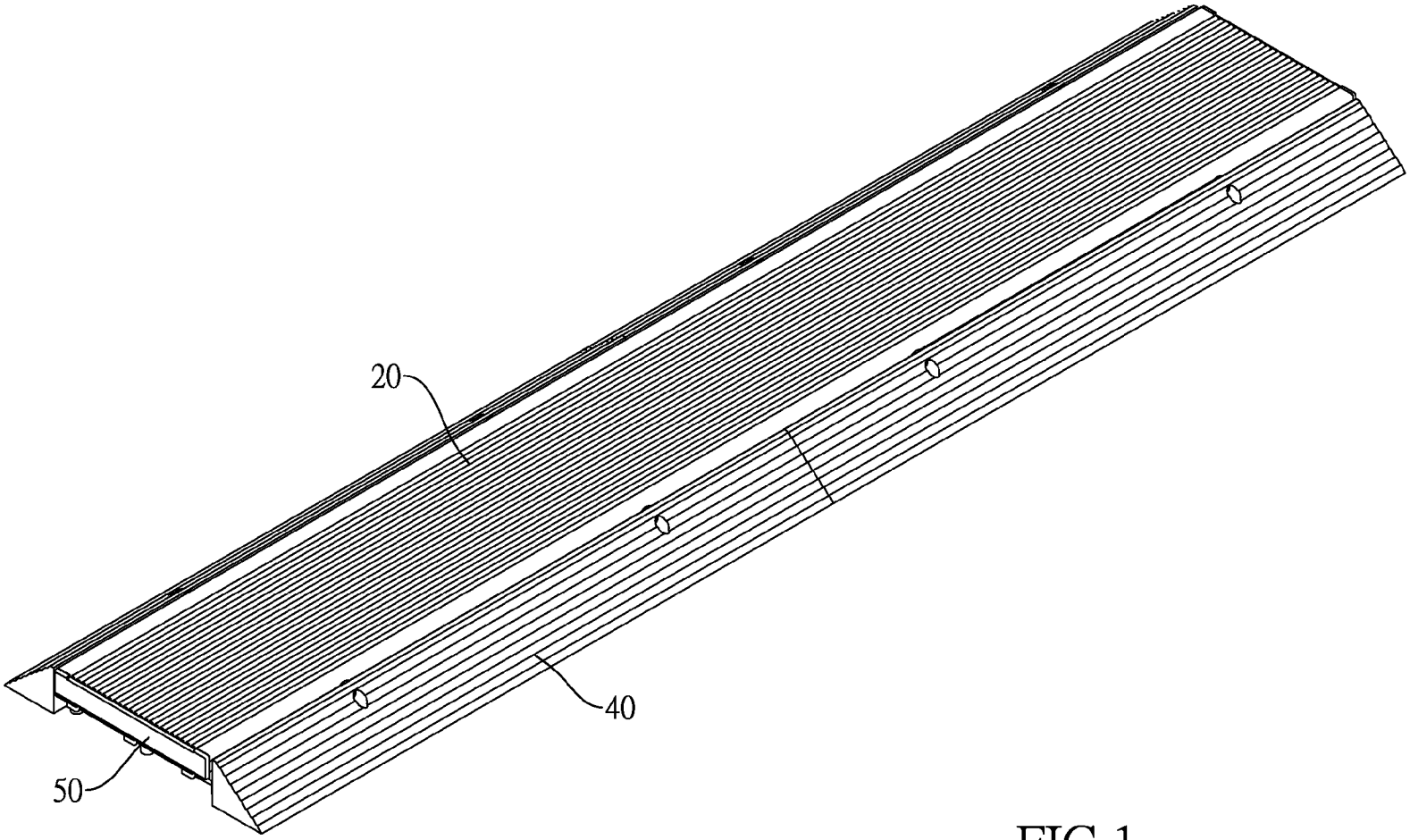
FIG. 1 is a perspective view of a deck plank in accordance with the present invention.
Figure 2:
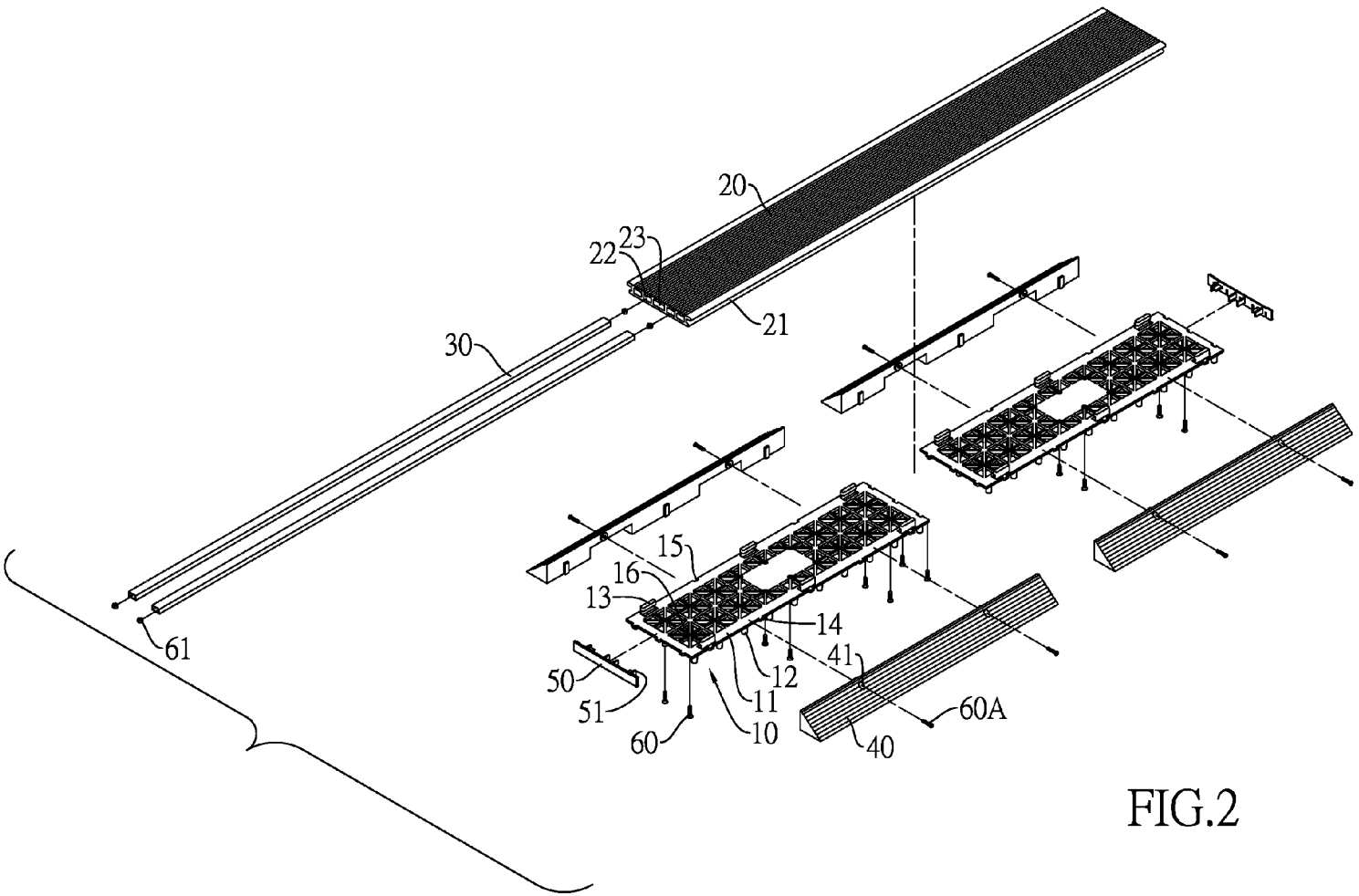
FIG. 2 is an exploded perspective view of the deck plank in FIG. 1.
Figure 3:
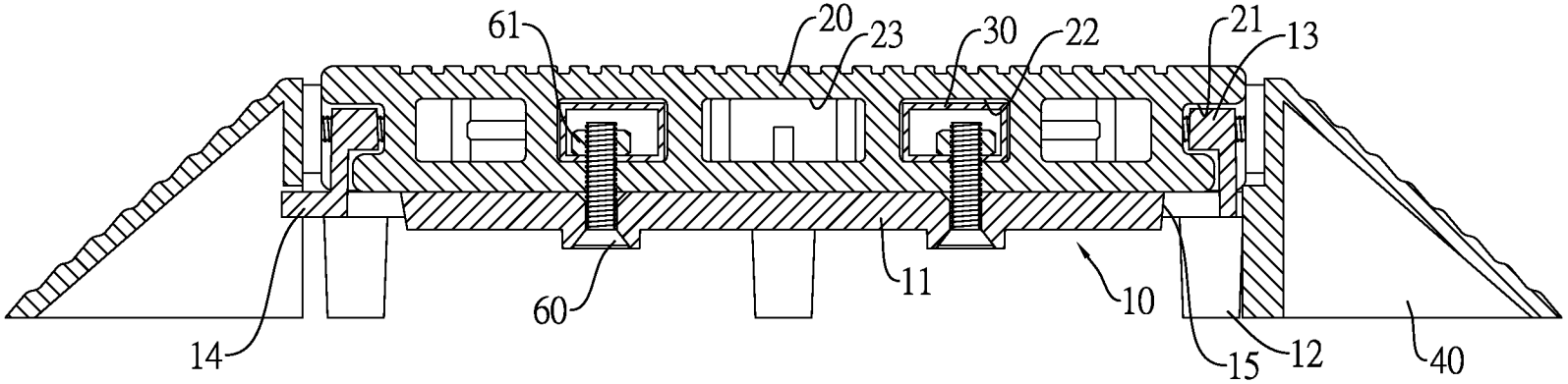
FIG. 3 is an enlarged side view in partial section of the deck plank in FIG. 1.

With reference to FIGS. 1 to 3, a deck plank in accordance with the present invention comprises at least one base 10, a top board 20, two reinforcing ribs 30, at least one ramp 40 and at least one side cover 50.

The at least one base 10 is made of plastic and includes a carrier board 11, a plurality of support columns 12, a plurality of hooks 13, a plurality of tabs 14, a plurality of notches 15 and a plurality of spaced apart holes 16. The carrier board 11 is rectangular and has a top surface, a bottom surface, two long sides and two short sides. The support columns 12 are spaced apart and extend from the bottom surface of the carrier board 11. The hooks 13 are spaced apart and extend from the top surface of the carrier board 11 along the long sides. The tabs 14 are spaced apart and extend from one long side and one short side of the carrier board 11. The notches 15 are spaced apart and formed in the other long side and the other short side of the carrier board 11. The positions of the tabs 14 on one long side correspond to the positions of the notches 15 on the other long side. The positions of the tabs 14 on one short side correspond to the positions of the notches 15 on the other short side. The shape of the tab 14 substantially conforms to the shape of the notch 15. The base 10 has the tabs 14 and notches 15 for engagement with an adjacent base 10. The holes 16 are formed through the carrier board 11.

The top board 20 is made of wood plastic composite (WPC). Wood plastic composite has improved water resistance and durability, incorporating the advantages of wood and plastic. The top board 20 is mounted on a top of the at least one base 10, is rectangular and has a top surface, two long sides, two short sides, two hooked channels 21, two receiving cavities 22 and a plurality of connecting cavities 23. The top surface of the top board 20 is level and has a plurality of grooves parallel to each other and to the long sides of the top board 20 for providing a skidproof surface thereon. The hooked channels 21 are formed in the long sides of the top board 20. The hooks 13 of the base 10 engage the hooked channels 21. The receiving cavities 22 and the connecting cavities 23 are formed in the top board 20, are spaced apart and parallel to each other and to the long sides of the top board 20. Each receiving cavity 22 is disposed between two adjacent connecting cavities 23. Each of the receiving cavities 22 and the connecting cavities 23 has two openings located on the two short sides of the top board 20.

The reinforcing ribs 30 are made of a suitable rigid material, such as steel or aluminum. The reinforcing ribs 30 are received in the receiving cavities 22 of the top board 20. The at least one base 10, the top board 20 and the reinforcing ribs 30 are secured together by bolts 60 and nuts 61, self tapping screws or any other suitable means. In a preferred embodiment, the bolts 60 extend through the holes 16 in the at least one base 10 and engage the top board 20 and the reinforcing ribs 30, and the nuts 61 are then threaded respectively onto the bolts 60 to secure the at least one base 10, the top board 20 and the reinforcing ribs 30 together.

The at least one ramp 40 is disposed on the long sides of the carrier board 11 and the top board 20 and has an inclined surface and a plurality of spaced apart holes 41. The inclined surface of the at least one ramp 40 permits rollers to pass easily. The inclined surface has a plurality of grooves parallel to each other and to the long sides of the carrier board 11 and the top board 20 for providing a skidproof surface thereon. Bolts 60A extend through the holes 41 in the at least one ramp 40 and then engage the long side of the top board 20 to secure the at least one ramp 40 to the top board 20.

The least one side cover 50 covers the short side of the top board 20 and includes an inner surface and a plurality of tongues 51. The tongues 51 extend from the inner surface of the cover 50, correspond to and engage the openings of the connecting cavities 23 of the top board 20.

In the preferred embodiment, the deck plank in accordance with the present invention comprises two bases 10, four ramps 40 and two side covers 50. The two bases 10 are assembled together by the tabs 14 and the notches 15 on adjacent short sides of the carrier boards 11. The four ramps 40 are each respectively disposed on the four long sides of the carrier boards 11 of the two bases 10. The two side covers 50 each respectively cover the two short sides of the top board 20.

Figure 4:
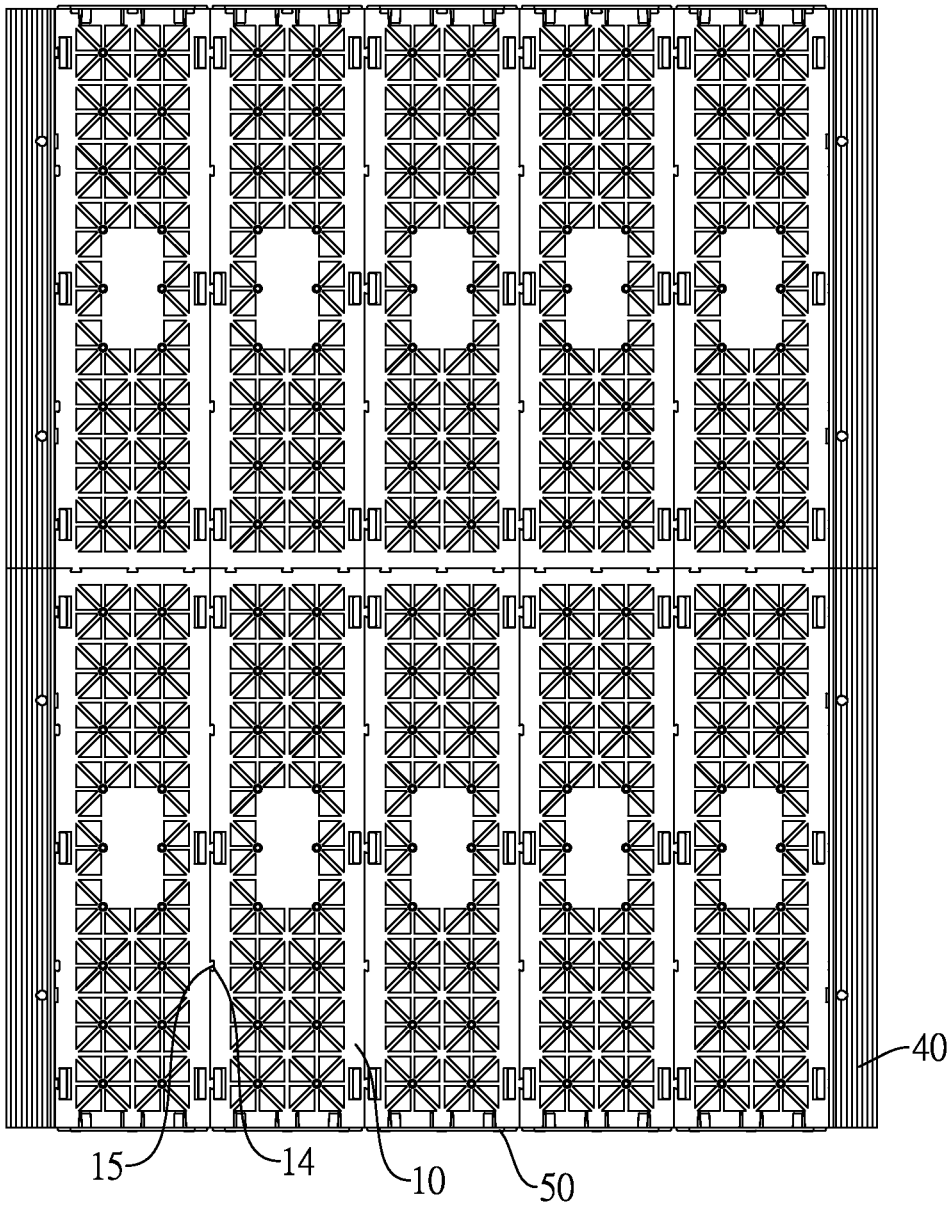
FIG. 4 is a top view of a deck comprised of a plurality of deck planks in accordance with the present invention without top boards.

With reference to FIG. 4, to construct a deck, a plurality of deck planks are placed side by side on the ground and assembled together by engaging the tabs 14 and the notches 15. The deck, as shown, has ten bases 10, four ramps 40 disposed on the four outermost long sides of the carrier boards 11 of the bases 10, and ten side covers 50 covering the ten outermost short sides of the carrier boards 11 of the bases 10.

With reference to FIG. 3, the top board 20 is spaced above from the ground by the support columns 12 of the base 10 such that the moisture from the ground does not penetrate the top board 20 to cause the top board 20 to become damp and rot. A space between the ground and the carrier board 11 provides ventilation to permit drainage of moisture. In addition, the top board 20 is structurally reinforced by the reinforcing ribs 30 to prevent deformation. Furthermore, the deck planks are easily and quickly assembled and disassembled by engaging and disengaging the cooperating tabs 14 and notches 15.

Even though numerous characteristics and advantages of the present utility model have been set forth in the foregoing description, together with details of the structure and features of the utility model, the disclosure is illustrative only. Changes may be made in the details, especially in matters of shape, size and arrangement of parts within the principles of the utility model to the full extent indicated by the broad general meaning of the terms in which the appended claims are expressed.

What is claimed is:

1. A deck plank comprising:

at least one base including:

a carrier board having a bottom surface; and a plurality of support columns extending from the bottom surface of the carrier board;

a top board mounted on a top of the at least one base and having two receiving cavities therein; and two reinforcing ribs received in the receiving cavities of the top board, wherein the carrier board of the at least one base has a top surface and two long sides; a plurality of hooks extend from the top surface of the carrier board along the long sides; and the top board has two long sides and two hooked channels formed in the long sides of the top board, and the hooks of the base engage the hooked channels, wherein the carrier board of the at least one base has two short sides, a plurality of tabs extend from one long side and one short side of the carrier board, a plurality of notches are formed in the other long side and the other short side of the carrier board, and the shape of the tab substantially conforms to the shape of the notch, wherein bolts extend through holes in the at least one base and engage the top board and the reinforcing ribs, and nuts are then threaded respectively onto the bolts to secure the at least one base, the top board and the reinforcing ribs together, wherein at least one ramp is disposed on the long sides of the carrier board and the long sides of the top board, wherein the top board has a top surface being level and having a plurality of grooves for providing a skidproof surface thereon; and the at least one ramp has an inclined surface having a plurality of grooves for providing a skidproof surface thereon, wherein at least one side cover covers one of two short sides of the top board, and wherein the top board has a plurality of connecting cavities therein, and each receiving cavity is disposed between two adjacent connecting cavities; and the at least one side cover includes an inner surface and a plurality of tongues extending from the inner surface and engaging openings of the connecting cavities of the top board.

2. The deck plank as claimed in claim 1, wherein bolts extend through holes in the at least one ramp and then engage the long sides of the top board to secure the at least one ramp to the top board.

3. The deck plank as claimed in claim 1 comprising:

two bases assembled together by the tabs and the notches on adjacent short sides of the carrier boards;

four ramps each respectively disposed on the four long sides of the carrier boards of the two bases; and two side covers each respectively covering the two short sides of the top board.

* * * * *